US005931408A

United States Patent [19]

Ishii et al.

[11] Patent Number: 5,931,408

[45] Date of Patent: Aug. 3, 1999

[54] METAL WIRE WINDING REEL WITH EASY WIRE ENGAGEMENT AND RELEASE

[75] Inventors: Isao Ishii; Kenji Sanda, both of Ono; Akio Kataoka, Nishiwaki, all of Japan

[73] Assignee: Tokusen Kogyo Co., Ltd., Hyogo, Japan

[21] Appl. No.: 08/937,964

[22] Filed: Sep. 25, 1997

[30] Foreign Application Priority Data

Jul. 30, 1997 [JP] Japan ..... 9-006668 U

[51] Int. Cl.[6] ..... B65H 19/29

[52] U.S. Cl. ..... 242/580; 242/125.3; 242/586.6

[58] Field of Search ..... 242/580, 125.2, 242/125.3, 586.4, 586.5, 586.6

[56] References Cited

U.S. PATENT DOCUMENTS

| | | |
|---|---|---|
| 1,044,014 | 11/1912 | Butts . |
| 1,681,263 | 8/1928 | Smith . |
| 2,302,965 | 11/1942 | Lucia . |
| 2,380,790 | 7/1945 | Robertson . |
| 3,758,045 | 9/1973 | Allen . |
| 4,412,662 | 11/1983 | Rutecki . |
| 5,485,968 | 1/1996 | Fujioka . |
| 5,549,257 | 8/1996 | Sanda et al. . |
| 5,586,733 | 12/1996 | Miura et al. . |
| 5,603,469 | 2/1997 | Stocchi . |

FOREIGN PATENT DOCUMENTS

| | | |
|---|---|---|
| 6-107377 | 4/1994 | Japan . |
| 3004340 | 11/1994 | Japan . |

*Primary Examiner*—Donald P. Walsh
*Assistant Examiner*—William A. Rivera
*Attorney, Agent, or Firm*—Marshall, O'Toole, Gerstein, Murray & Borun

[57] ABSTRACT

A base (17*a*) of a flat end engaging member (17) which protrudes from a hole (19) is fixed on an outside surface of a flange (15) installed at each end of a winding drum (14) in such a manner that the end engaging member (17) is fitted in a groove (16) provided at least at one point of an inside surface of the flange (15). A guide portion (18) is continuously provided on an upper side of the groove (16). The guide portion (18) is an inclined surface extending obliquely upward from each corner of the groove (16) to an outer peripheral edge of the flange (15). An engaging fragment (17*b*) which is bent toward a guide portion (18) side is provided in a tip portion of the end engaging member (17). Furthermore, the guide portion (18) and the engaging fragment 17*b* are provided with engaging portions (20) and (21) comprising recesses which are concaved in the same direction, respectively.

9 Claims, 12 Drawing Sheets

METAL WIRE WINDING REEL WITH EASY WIRE ENGAGEMENT AND RELEASE

FIELD OF THE INVENTION

The present invention relates to a metal wire winding reel (hereinafter referred to as a "reel") for winding a metal wire including a steel wire, a steel cord, a wire rope or an electric wire.

PRIOR ART

As a conventional structure for taking up a metal wire on a reel and fixing an end of the metal wire when wound up full, as shown in FIG. 12, a reel 44 generally comprises a small hole 42 formed on the outer periphery of a flange 41 and an end engaging member 43 of a steel wire or a plate spring formed like an almost U-shape on an outside surface of the flange 41 in the proximity of the small hole 42. An end W0 of the metal wire led out of the small hole 42 is held between the end engaging member 43 and the outside surface of the flange 41.

In the prior art, it takes time to pass the end W0 of the metal wire through the small hole 42, and the work is troublesome for taking the end W0 out of the small hole 42 at the time of wire release.

In a steel cord which has been used for a tire, steel cords are normally supplied from 500 reels or more in a rubber coating (calendaring) process which is one of intermediate steps of tire manufacture. In that case, it is necessary to carry out a work of releasing, from an end engaging member, ends of the steel cords supplied from hundreds of reels. Therefore, it takes plenty of labor and time. Furthermore, in the case where the metal wire is a stranding wire such as a steel cord or a wire rope, the end W0 becomes loose, making it difficult to pass the metal wire through the small hole 42. It is therefore necessary to cover the end W0 with a tape or fuse strands together by welding in advance, thereby requiring a very troublesome work.

In order to solve the above-mentioned problems, Japanese Unexamined Patent Publication No. 6-107377 has disclosed a reel 55 comprising an end engaging member 54 which has a holding portion 53 on a tip thereof, the holding portion 53 capable of appearing on a window 52 formed on a flange 51 as shown in FIGS. 13(*a*) and 13(*b*). In the reel 55, the end engaging member 54 is pressed inward from the outside of an outer end face of a flange so that it is elastically deformed. Only the holding portion 53 is pressed into the window 52 and an end W0 of the metal wire is fitted in the holding portion 53. Then, a press force is released to hold the end W0 of the metal wire.

According to this technique, it is not necessary to pass the end of the metal wire through the small hole. Also during wire release, the end does not need to be taken out of the small hole. Consequently, working efficiency can be enhanced. However, the end engaging member fixed on the outside surface of the flange greatly protrudes therefrom. For this reason, there has been a drawback that reel flanges come in contact with each other or the end engaging member is pushed during stacking so that the end of the metal wire comes off from the end engaging member when packing product reels or performing handling such as transportation.

Japanese Utility Model No. 3004340 has proposed a reel 64 having a structure in which a groove 62 is provided in a radial direction toward an outer peripheral edge of a flange 61, an end engaging member 63 of a metal wire made of a flat metal plate is fitted in the groove 62, and a base of the end engaging member 63 and the flange 61 are fixed by spot-weld B as shown in FIGS. 14(*a*) and 14(*b*).

However, in the case where the end of the metal wire is engaged by means of the reel 64, the end engaging member 63 is bent by using, as a supporting point, a fixing portion of the base of the end engaging member 63 as shown in FIG. 15. Therefore, a stress converges on the fixing portion. The spot-weld is usually used for the fixing portion. Since a metal structure is affected by thermal effect during welding, a strength and a toughness of the fixing portion is greatly reduced. For this reason, the fixing portion is plastic-deformed by bending and tension, and the end engaging member 63 is broken in the worst case.

Furthermore, the fixing portion requires a great fixing force, and spot welding is performed on the fixing portion. Therefore, annealing is caused by heat generated during spot-welding in the vicinity of the spot-weld. Consequently, a press force is greatly reduced in a direction in which the end of the metal wire is pressed. As a result, the end of the metal wire cannot surely be engaged.

In addition to this defect, in the case where the metal wire is deeply inserted into a clearance between the end engaging member and the flange in order to obtain a greater engagement force, the end engaging member 63 is greatly warped by an end W0 of the metal wire as shown in FIG. 15 so that breakage is caused. This kind of reel is not usually disposable but reused many times. For this reason, the service life of the reel is greatly shortened due to the above-mentioned troubles.

In the reel 64, the metal wire enters a clearance between the base of the end engaging member 63 and a bottom of the groove 62. Therefore, the metal wire is caught in the base of the end engaging member 63 during wire release so that a disconnection or defective reform is caused.

The reel 64 has a small clearance between the end engaging member 63 and each upper corner of the groove 62. For this reason, the metal wire cannot smoothly be inserted into the end engaging member 63. Therefore, when inserting the end W0 of the metal wire into the end engaging member 63, the metal wire should be "kneaded". Also during the wire release, the metal wire does not smoothly come off from the end engaging member 63. Therefore, the metal wire should be "scooped up". Such works are painful to workers and reduce working efficiency.

Recently, a work of engaging the end of the metal wire when wound up full and that of releasing the metal wire in a calendaring process can automatically be performed by machines. Accordingly, it is necessary for a reel to have an end engaging structure in which wire release can smoothly be performed.

SUMMARY OF THE INVENTION

In order to solve the problems of the reel according to the prior art, it is an object of the present invention to provide a reel capable of easily engaging an end of a metal wire and releasing the metal wire so that troubles can be eliminated during handling, and of surely engaging the end of the metal wire, of corresponding to automated engagement and wire release and of preventing the reel from being deformed or broken so that the reel can be used over a long period of time.

In order to attain the above-mentioned object, the present invention provides a novel reel having an end engaging structure of a metal wire in which a flange is fixed on each end of a winding drum, and a flat end engaging member is installed in such a manner as to be fitted in a groove provided at least at one point in a radial direction from an almost central portion of an inside surface of a flange to an outer peripheral edge of the flange.

The present invention provides a metal wire winding reel comprising a flange at each end of a winding drum, characterized in that a groove having a hole on a bottom is provided in a radial direction to an outer peripheral edge of the flange at least at one point on an inside surface of the flange, a flat end engaging member having elasticity is installed in such a manner as to be fitted in the groove, a clearance is formed between a tip of the end engaging member and the outer peripheral edge of the flange, and a base protruding from an outside surface of the flange through the hole is fixed in such a manner as to abut on the outside surface of the flange.

According to the present invention having the above-mentioned structure, the base having the end engaging member fixed thereon protrudes from the outside of the flange through the hole of the bottom of the groove provided in the radial direction to the outer peripheral edge of the flange. Therefore, the clearance is not formed between the base and the groove. Thus, it is possible to solve the problem of the prior art that the metal wire W enters the clearance during wire release.

The metal wire is taken up on the reel, and the end of the metal wire is inserted into a portion between the end engaging member and the flange when wound up full. Consequently, the end of the metal wire is fixed by a press force generated by elasticity of the end engaging member. A portion in which the hole comes in contact with the end engaging member acts as a supporting point and the end engaging member is bent in this portion. Therefore, even if thermal effect is produced by spot-welding in the vicinity of the base so that an elastic limit is reduced, a press force acting in a direction in which the end of the metal wire is pressed is not lowered. Consequently, the metal wire can surely be engaged. In addition, a stress does not converge on the fixing portion so that plastic deformation can be prevented. Therefore, the number of times at which the reel is reused can be increased remarkably.

During the wire release, the wire can easily be released by pulling the end of the metal wire upward with some strength. The end engaging member is provided in such a manner as to be fitted in the groove provided on the inside surface of the flange, and the tip portion of the end engaging member is slightly bent toward the outer periphery along the outer peripheral edge of the flange. Therefore, the metal wire is not rubbed against or caught in the end engaging member when taking up the metal wire on the reel or supplying the metal wire from the reel.

In addition, the continuous unevenness is provided in the boundary portion of at least each side of the groove and the inside surface of the flange, or the hemispherical projection is provided on the inside surface of the flange in the proximity of the groove. Consequently, the end of the metal wire can surely be engaged. In addition, the corrugated projection is provided on the face in which the groove engaging the end of the metal wire comes in contact with the end engaging member. Consequently, the end of the metal wire can be engaged more surely. If the tip of the end engaging member is subjected to the chamfering processing or peak forming processing, the end of the metal wire can easily be inserted.

Furthermore, the present invention provides a metal wire winding reel comprising a flange fixed on each end of a winding drum, and a flat end engaging member installed in such a manner as to be fitted in a groove provided in a radial direction of an inside surface of the flange, characterized in that a guide portion is continuously provided on an upper side of the groove, the guide portion being an inclined surface extending obliquely upward from each corner of the groove to an outer peripheral edge of the flange, an engaging fragment which is bent toward a guide portion side is formed in a tip portion of the end engaging member, an engaging portion is provided in at least one of the guide portion and the engaging fragment, a clearance is formed between the guide portion and the engaging fragment, and a base of the end engaging member which protrudes from a hole on a bottom of the groove is fixed integrally with an outside surface of the flange in such a manner that an end of a metal wire is engaged by the engaging portion.

According to the present invention having the above-mentioned structure, the metal wire is taken up on the reel, and the end of the metal wire is smoothly led in from the inclined surface of the guide portion when wound up full and is fixed by a press force generated by elasticity of the end engaging member. At this time, a portion in which the hole of the groove comes in contact with the end engaging member acts as a supporting point and the end engaging member is bent in this contact portion. Therefore, even if thermal effect is produced by spot-welding in the vicinity of the base of the end engaging member so that an elastic limit is reduced, a press force acting in a direction in which the end of the metal wire is pressed is not lowered. Consequently, the end of the metal wire can surely be engaged. In addition, a stress does not converge on the fixing portion so that plastic deformation can be prevented. Therefore, the number of times at which the reel is reused can be increased remarkably. During the wire release, the press of the engaging fragment of the end engaging member is removed by pulling the end of the metal wire upward with some strength. Thus, the metal wire can easily be released.

If the guide portion is continuously provided on the groove and the clearance is formed between the engaging fragment of the end engaging member and the guide portion or the clearance which is almost equal to the diameter of the metal wire is preferably formed between the upper center of the guide portion and the back of the tip portion of the engaging fragment, the guide portion acts as a guide during engagement of the end of the metal wire and wire release. Consequently, the lead-in and lead-out operations can smoothly be performed. In addition, a work of engaging the end of the metal wire can easily be performed.

Furthermore, the engaging portion for engaging the end of the metal wire is provided on at least one of the guide portion and the engaging fragment. Therefore, also in the case where the press force of the end engaging member is small, the engaging portion functions as a kind of stopper. Consequently, the end of the metal wire can surely be prevented from coming off.

Preferably, the engaging portion has a structure wherein the guide portion and the engaging fragment are provided with the recesses concaved in the same direction in such a manner as to be fitted in each other or projections which are concaved in opposite directions and have apexes to almost come in contact opposite to each other, or one of them has the projection and the other has a small hole in which a part of the projection or the whole projection is fitted. In some cases, only the guide portion is provided with the projection or only the engaging fragment is provided with the recess so that the processing can be simplified. In these cases, if the apex of the projection or recess almost comes in contact with the other face, the end can be prevented from coming off more surely. Furthermore, the engaging portion can have an appropriate shape such as an unevenness, a streak, a corrugation and the like in addition to the recess and the projection.

If the tip of the engaging fragment of the end engaging member is made round due to the chamfering processing or the peak forming processing and is slightly bent toward a winding drum side, the end of the metal wire can be engaged more smoothly.

A carbon steel for a general structure, a special steel, a cast steel and the like can properly be used for a material of the reel (the winding drum and the flange). The groove of the flange and the guide portion can be formed by a press processing or a grinding processing.

The end engaging member is usually a flat plate which is made of a metal having great elasticity and has a thickness of about 1 mm and a width of about 10 mm. If a press force should be varied depending on the metal wire, it is preferable that the thickness and the width of the flat plate should properly be changed.

The outside surface of the flange and the base of the end engaging member are usually fixed by spot-welding. Depending on the material of the flange, it is possible to select other fixing means such as an adhesive for metals, a bolt and a nut, a machine screw and the like.

DESCRIPTION OF PREFERRED EMBODIMENTS

Preferred embodiments of the present invention will be described below with reference to the drawings.

Figure 1:
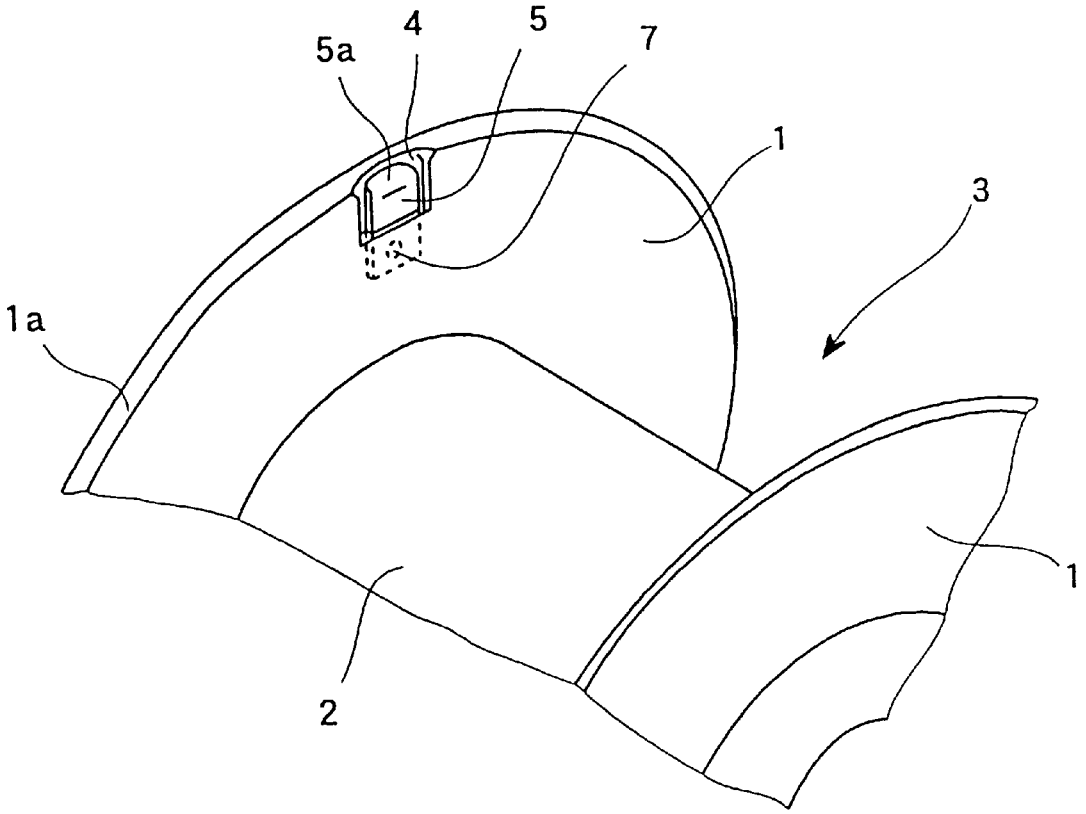
FIG. 1 is a partially broken perspective view showing a metal wire winding reel according to the present invention.
Figure 2:
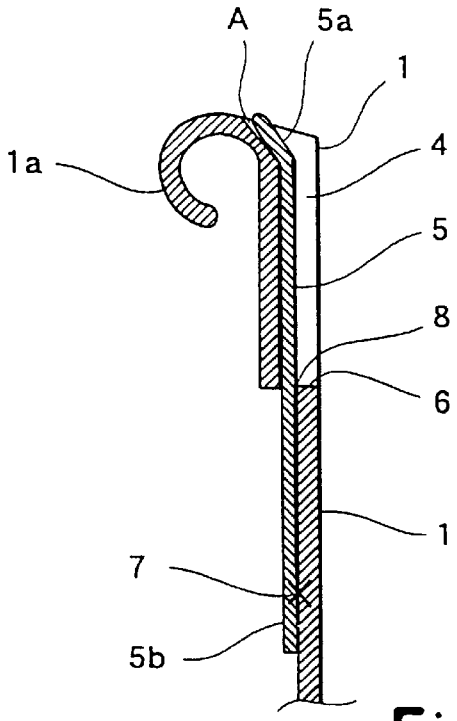
FIG. 2 is an enlarged sectional view showing a main part of FIG. 1.

As shown in FIGS. 1 and 2, a metal wire winding reel comprises flanges 1, 1 provided at both ends of a winding drum 2. In the metal wire winding reel, a groove 4 is provided on an inside surface of the flange 1 in a radial direction toward an outer peripheral edge 1*a* of the flange 1, an end engaging member 5 made of a flat metal elastic member protrudes from an outside surface of the flange 1 through a hole 8 formed on a bottom 6 of the groove 4 in such a manner as to be fitted in the groove 4, and a base 5*b* is fixed on the outside surface of the flange 1 by spot-weld 7. Thus, a metal wire winding reel 3 according to the present invention has been fabricated.

While a metal has been used for the flat elastic member of the end engaging member 5, an elastic material such as plastic may be used.

While a flat metal plate has been used for the end engaging member in the embodiment, a metal plate may have an uneven surface or a corrugated surface made by the appropriate processing in such a manner that an end of a metal wire is fitted in the resulting recess. In order to improve a friction force between the end engaging member and the end of the metal wire, the surface roughness of the end engaging member may be increased.

Preferably, a length of an inside portion of the flange of the end engaging member is about 30 to 60% of the total length of the end engaging member.

In FIG. 2, an engaging fragment 5*a* of the end engaging member 5 is slightly bent toward the outer periphery along the outer peripheral edge 1*a* of the flange 1, and a small clearance A is formed with the outer peripheral edge 1*a* of the flange 1. A tip corner of the engaging fragment 5*a* is chamfered. A lower end side of the end engaging member 5 protrudes from the outside surface of the flange 1 through the hole 8 formed on the bottom 6 of the groove 4. The base 5*b* protruding from the outside surface of the flange 1 is fixed on the flange 1 by the spot-weld 7.

Figure 3:
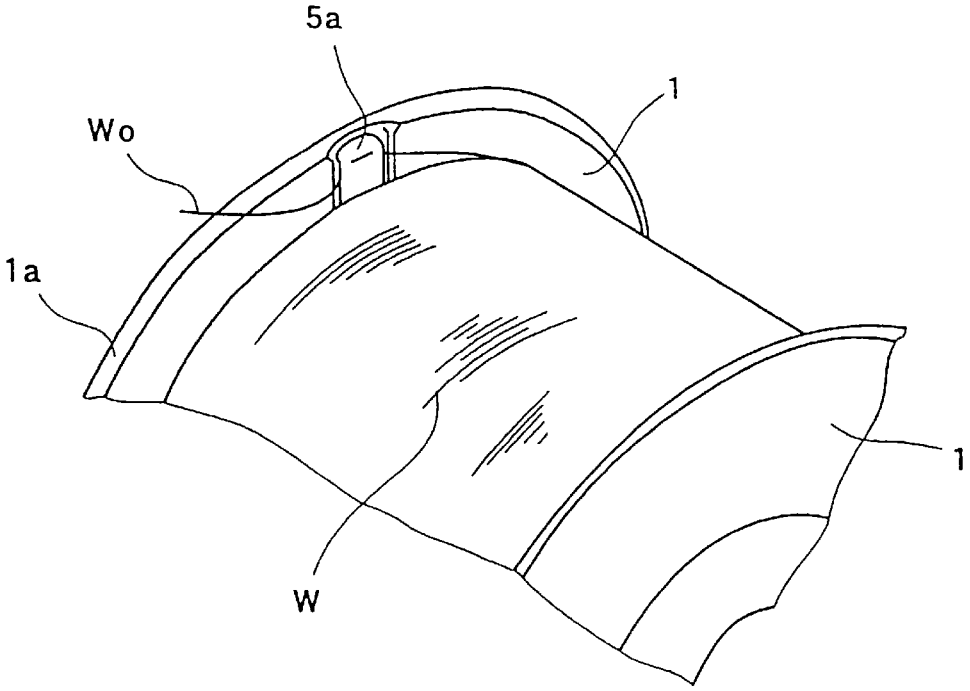
FIG. 3 is a partially broken perspective view showing an engagement state of an end of a metal wire of the metal wire winding reel according to the present invention.

By using the reel thus fabricated, a steel cord having a so-called 1×7 structure which is formed by stranding seven metal strands having a diameter of 0.33 mm was actually taken up as shown in FIG. 3. The steel cord has a diameter of 0.99 mm. An end W0 is led in through the clearance A shown in FIG. 2 and is pulled in a central direction of the reel. Thus, the end W0 is tightly held between the end engaging member 5 and the flange 1.

Figure 4:
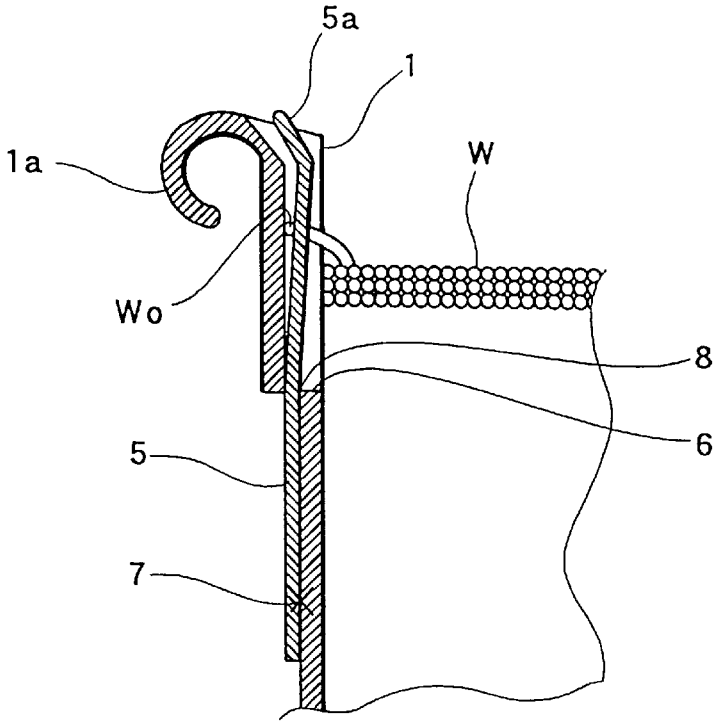
FIG. 4 is an enlarged sectional view showing a main part of FIG. 3.

An engagement state of the end W0 of a metal wire W shown in FIG. 3 will be described in detail with reference to FIG. 4. The end W0 of the metal wire W is pulled into a portion between the end engaging member 5 and the flange 1 so that the end engaging member 5 is warped in the arcuate form to an extent which does not exceed an elastic limit by using, as a supporting point, a contact portion of the hole 8 and the end engaging member 5. Thus, a press force is generated in a direction in which the end W0 of the metal wire W is pressed. A static friction force is generated between the end engaging member 5 and the end W0 of the metal wire W and between the end W0 of the metal wire W and the flange 1, respectively. By this force, the end W0 of the metal wire W is held.

Then, it was confirmed that wire release can easily be performed by pulling the end W0 of the metal wire W upward with some strength. After the wire release, the end engaging member 5 returned to a flange side by its own elasticity and restored the shape thereof as shown in FIG. 2.

If the clearance A between the engaging fragment 5*a* of the end engaging member 5 and the outer peripheral edge 1*a* of the flange 1 is too large, the metal wire W is caught in the tip portion when taking up the reel. Accordingly, it is preferable that the end W0 of the metal wire W should enter the clearance A in such a manner as to almost come in contact with the outer peripheral edge 1*a* of the flange 1.

Figure 5:
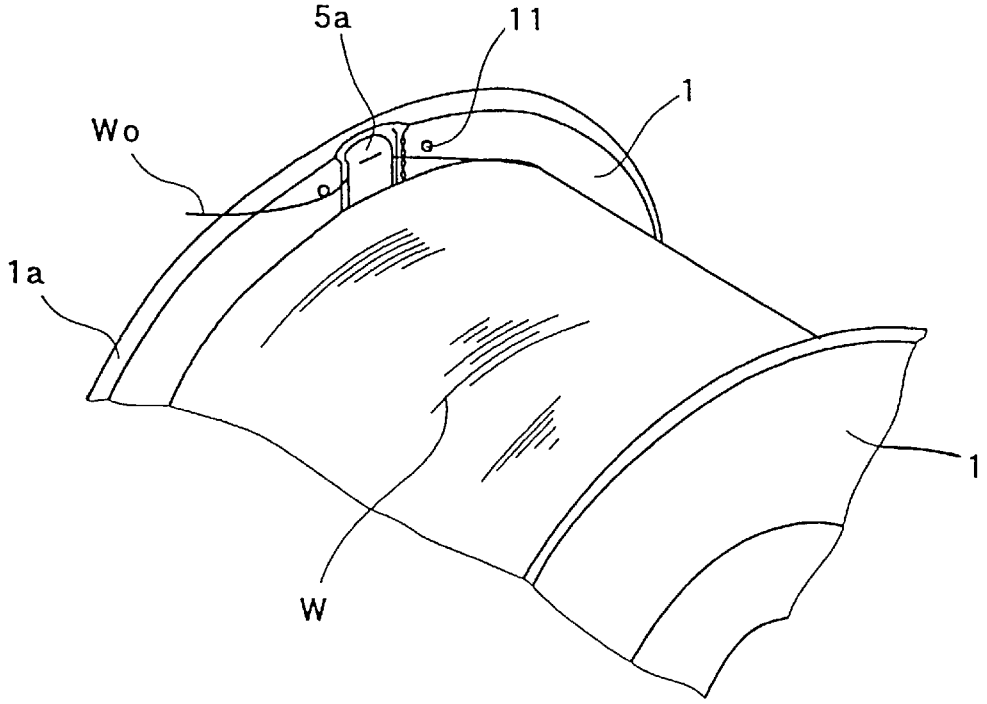
FIG. 5 is a partially broken perspective view showing an engagement state of an end of a metal wire of a metal wire winding reel according to another embodiment of the present invention.
Figure 6:
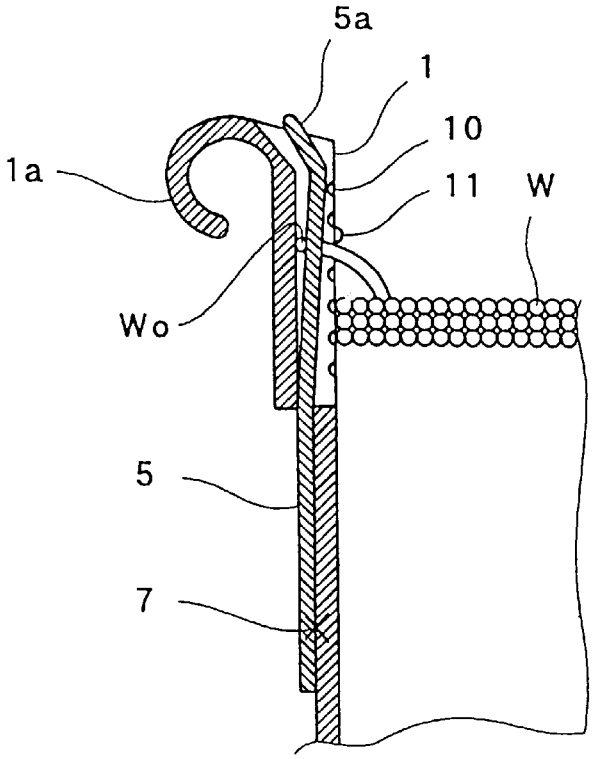
FIG. 6 is an enlarged sectional view showing a main part of FIG. 5.
Figure 7:
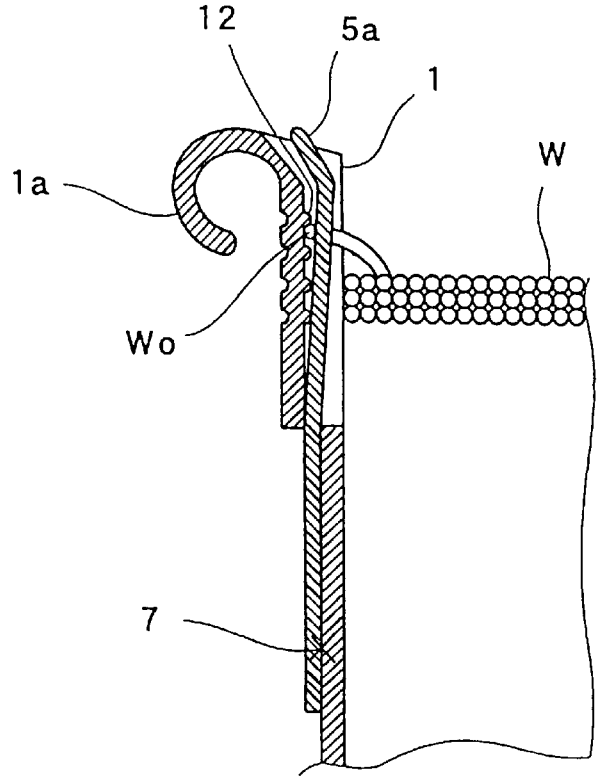
FIG. 7 is an enlarged sectional view showing an engagement state of an end of a metal wire of a metal wire winding reel according to yet another embodiment of the present invention.

FIG. 5 shows an end engaging member according to another embodiment. FIG. 6 is an enlarged sectional view showing the end engaging member. According to the embodiment shown in FIGS. 5 and 6, a continuous unevenness 10 is provided over at least an end engaging position of the metal wire W in a boundary portion of the groove 4 and the inside surface of the flange 1, and a hemispherical projection 11 is provided on the inside surface of the flange 1 in the vicinity of the end engaging member 5. FIG. 7 is an enlarged sectional view showing a further embodiment, in which a corrugated projection 12 is provided on a surface of the groove 4 engaging the end W0 of the metal wire W which is in contact with the end engaging member. With structures shown in FIGS. 5 to 7, it is possible to engage the end of the metal wire more surely.

In order to confirm thermal effect on the end engaging member produced by spot-welding according to the present invention, a comparison test was performed to compare the thermal effect of the reel according to the embodiment of the present invention with that of the conventional reel described in the Japanese Utility Model No. 3004340. Consequently, a result shown in Table 1 was obtained.

The thermal effect on the end engaging member produced by the spot-welding is compared based on a residual clearance distance obtained when forming and opening a clearance between the end engaging member and the outer peripheral edge of the flange. If the residual clearance distance is smaller, the thermal effect is reduced more. The clearance is formed while increasing an open width at an interval of 2 mm. The opening operation is repeated. Every time the forming and opening operations were performed once, the residual clearance distance was measured.

TABLE 1

| | Residual clearance distance (mm) | | | | | | | | | | |
|---|---|---|---|---|---|---|---|---|---|---|---|
| Open Width(mm) | 0 | 2 | 4 | 6 | 8 | 10 | 12 | 14 | 16 | 18 | 20 |
| Preferred embodiment | 0 | 0 | 0 | 0 | 0 | 0 | 0 | 0 | 0.5 | 1.0 | 2.0 |
| Preferred embodiment | 0 | 0 | 0 | 0 | 0 | 0 | 0 | 0 | 0.3 | 0.7 | 1.5 |
| Preferred embodiment | 0 | 0 | 0 | 0 | 0 | 0 | 0 | 0.2 | 0.5 | 0.8 | 1.8 |
| Prior art | 0 | 0 | 0 | 0.3 | 0.5 | 0.8 | 1.0 | 1.7 | 2.6 | 5.0 | Fixing position is broken |
| " | 0 | 0 | 0 | 0.4 | 0.7 | 0.9 | 1.5 | 2.3 | 6.7 | Fixing position is broken | — |
| " | 0 | 0 | 0.2 | 0.3 | 0.5 | 0.7 | Fixing position comes off | — | — | — | — |

As shown in Table 1, the reel according to the present invention is affected by the spot-welding with difficulty. It was clear that the reel according to the present invention is remarkably excellent than the conventional reel.

Figure 8A:
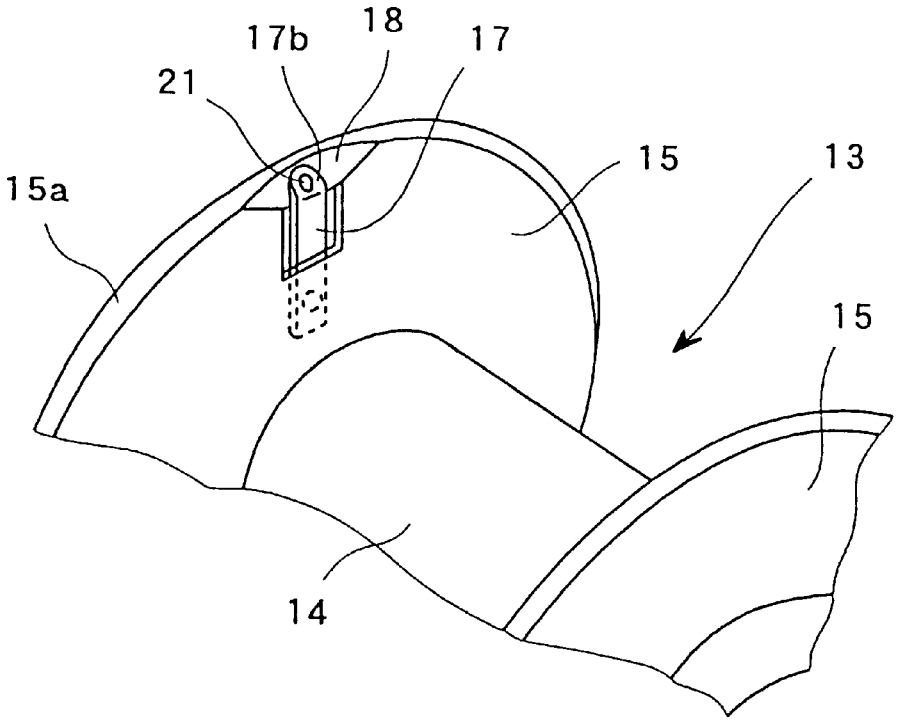
FIG. 8 shows a metal wire winding reel according to a further embodiment of the present invention, FIG. 8(*a*) being a partially broken perspective view, and FIG. 8(*b*) being an enlarged sectional view showing a main part.
Figure 8B:
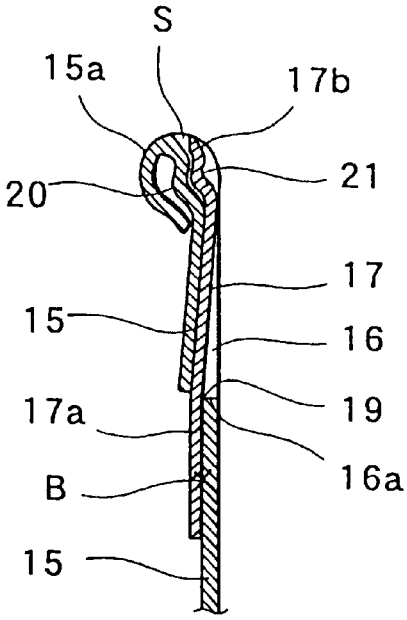

In FIG. 8, a reel 13 has a structure in which flanges 15, 15 are provided at both ends of a winding drum 14, a groove 16 is provided in a radial direction from an almost central portion of an inside surface of the flange 15 to an outer peripheral edge 15*a* of the flange 15, an end engaging member 17 made of a flat metal elastic member protrudes from an outside surface of the flange 15 through a hole 19 formed on a bottom 16*a* of the groove 16 in such a manner as to be fitted in the groove 16, and a base 17*a* of the end engaging member 17 is fixed on the outside surface of the flange 15 by spot-weld B.

A guide portion 18 is continuously provided on an upper side of the groove 16. The guide portion 18 is an inclined surface which extends obliquely upward from each corner portion of the groove 16 to the outer peripheral edge 15*a* of the flange 15. An engaging fragment 17*b* which is slightly bent outward along the guide portion 18 is provided in a tip portion of the end engaging member 17. A small clearance S is formed between the engaging fragment 17*b* and the guide portion 18. The clearance S acts as a lead-in portion to smoothly insert the end of the metal wire into a portion between the end engaging member 17 and the guide portion 18.

If the tip of the engaging fragment 17*b* of the end engaging member 17 is subjected to a peak forming processing for making a taper and a chamfering processing for rounding as shown in FIGS. 8(*a*) and 8(*b*), the end of the metal wire can be led in more smoothly.

The guide portion 18 and the engaging fragment 17*b* are provided with engaging portions 20 and 21 comprising recesses which are concaved in the same direction and fitted in each other, respectively. The engaging portions 20 and 21 prevent the end of the metal wire from coming off from the clearance between the guide portion 18 and the engaging fragment 17*b*.

Figure 9A:
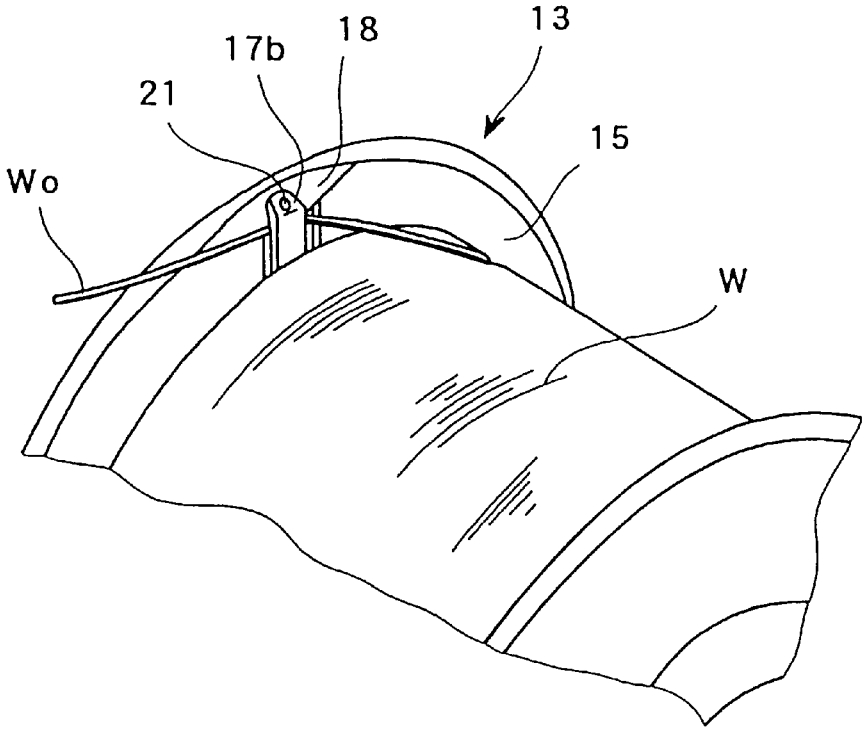
FIG. 9 shows an engagement state of an end of a metal wire of the reel in FIG. 8, FIG. 9(*a*) being a partially broken perspective view, and FIG. 9(*b*) being an enlarged sectional view showing a main part.
Figure 9B:
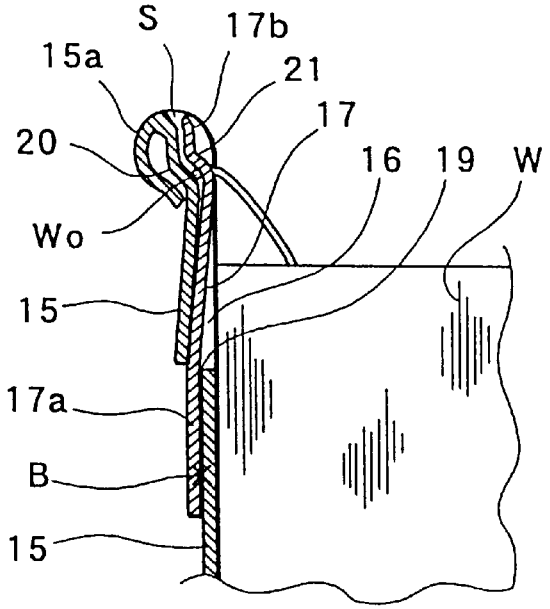

By using the reel 13 having the above-mentioned structure, a steel cord W having a so-called 1×7 structure in which seven metal strands having a diameter of 0.25 mm are stranded, for example, is taken up. An end W0 is led in from the clearance S along the guide portion 18, and is pulled into a position which has passed through the engaging portions 20 and 21 as shown in FIGS. 9(*a*) and 9(*b*). Consequently, the end W0 can be held easily and surely.

An engagement state of the end W0 of the metal wire W will be described in detail with reference to FIG. 9(*b*). When the end W0 of the metal wire W is pulled into a portion between the engaging fragment 17*b* of the end engaging member 17 and the guide portion 18 of the flange 15, the end engaging member 17 is warped in the arcuate form within an elastic limit by using a contact portion with the hole 19 as a supporting point. Consequently, a press force is generated on the engaging fragment 17*b* in a direction in which the end W0 of the metal wire W is pressed. A static friction force is generated between the end engaging member 17 and the end W0 of the metal wire W and between the end W0 of the metal wire W and the flange 15, respectively. By this force, the end W0 of the metal wire W is held. Furthermore, the engaging portions 20 and 21 function as stoppers. Therefore, even if the press force of the end engaging member 17 is small, the end W0 can surely be engaged.

Then, wire release can easily be performed by pulling the end W0 of the metal wire W upward with some strength. After the wire release, the end engaging member 17 returns to a flange side by its own elasticity and restores a state shown in FIG. 8(*b*).

If the clearance S between the engaging fragment 17*b* and the guide portion 18 is much larger than a diameter of the metal wire W, the metal wire W is caught in the tip portion of the engaging fragment 17*b* when taking up the metal wire W on the reel. Accordingly, it is preferable that the clearance S should be almost equal to the diameter of the metal wire W.

Figure 10A:
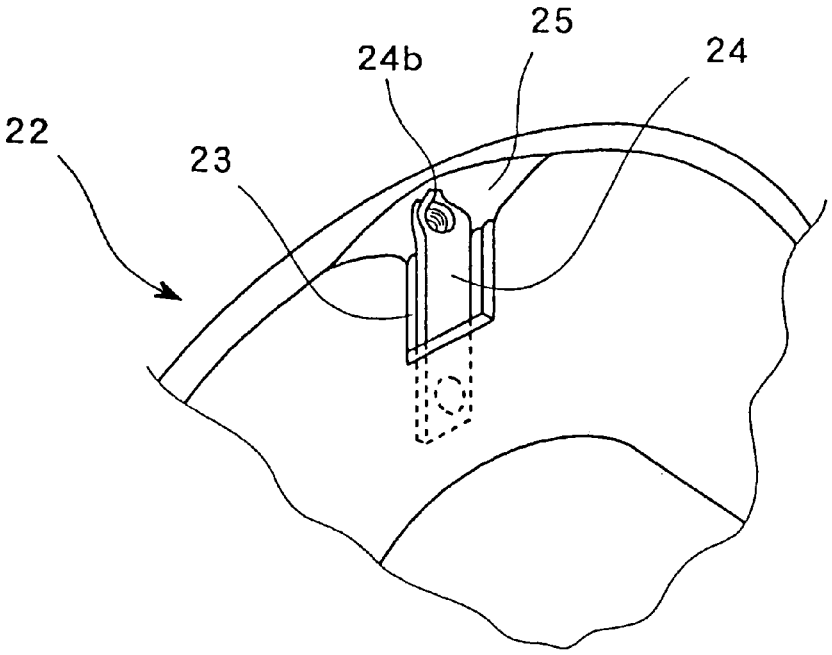
FIG. 10 shows a metal wire winding reel according to a further embodiment of the present invention, FIG. 10(*a*) being a partially broken perspective view, and FIG. 10(*b*) being an enlarged sectional view showing a main part in an engagement state of an end of a metal wire.
Figure 10B:
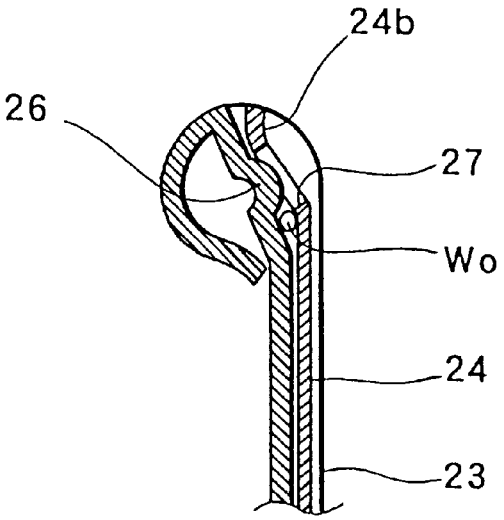

According to an embodiment shown in FIG. 10, a reel 22 has a structure in which an end engaging member 24 is fixed on a groove 23 as described above, an engaging portion 26 comprising a projection which protrudes onto an engaging fragment 24*b* side is provided in an almost central portion of a guide portion 25, and an engaging portion 27 comprising a small hole in which the engaging portion 26 is fitted is provided on the engaging fragment 24*b* of the end engaging member 24.

By using the reel 22, the same steel cord described above is taken up, and an end W0 of a metal wire W is led in from a clearance S along the guide portion 25, and is pulled into a position which has passed through the engaging portions 26 and 27 as shown in FIGS. 10(*a*) and 10(*b*). Consequently, the end W0 of the metal wire W can be engaged easily and surely.

A corner of a tip of the engaging fragment 24*b* of the end engaging member 24 is chamfered and is slightly warped upward. Consequently, the end W0 of the metal wire W can be led in from the clearance S more easily.

Also in the case where the engaging portion 27 is a recess having such a size as to cause the engaging portion 26 to be fitted in the engaging fragment 24*b* of the end engaging member 24, the same effects can be obtained.

Figure 11A:
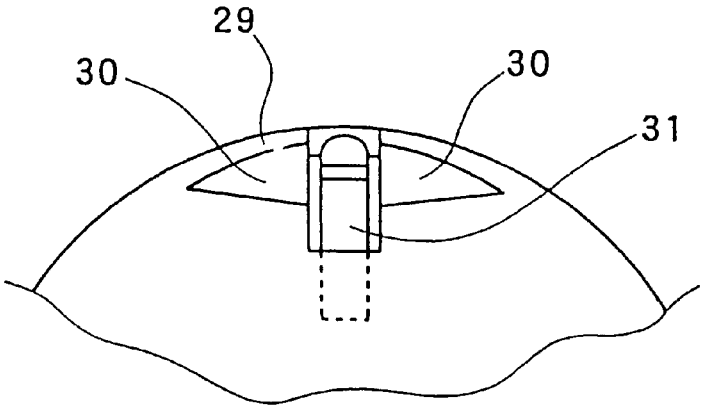
FIG. 11 shows a metal wire winding reel according to a further embodiment of the present invention, FIG. 11(*a*) being a partially broken side view, and FIG. 11(*b*) being an enlarged sectional view showing a main part.
Figure 11B:
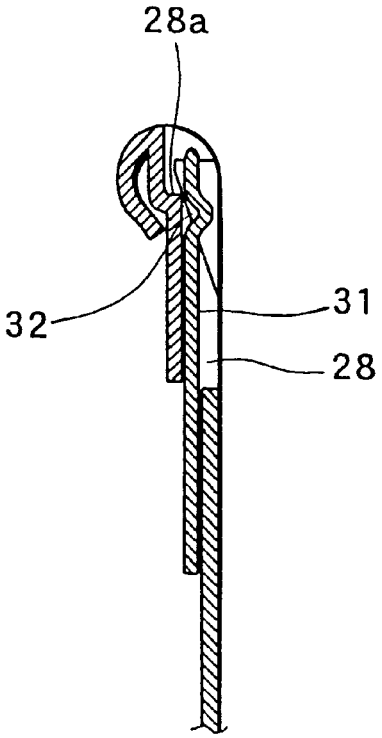
Figure 12:
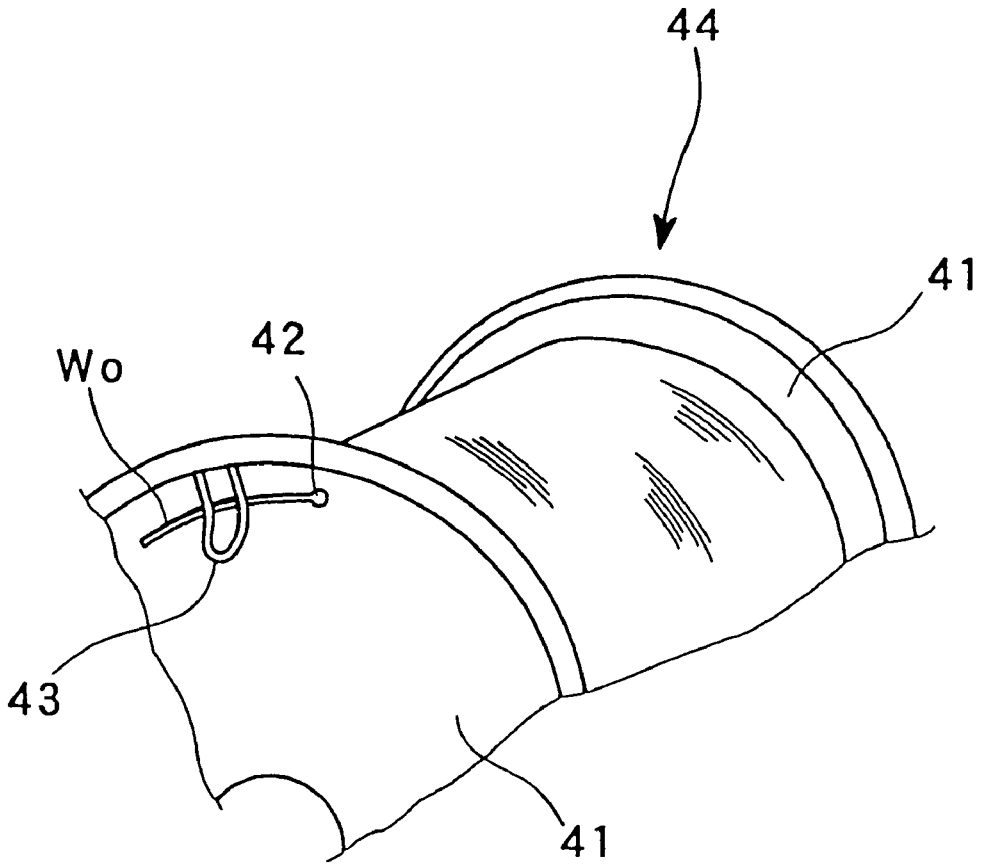
Fig. 12 PRIOR ART
FIG. 12 is a partially broken perspective view showing an engagement state of an end of a metal wire of a metal wire winding reel according to the prior art.
Figure 13A:
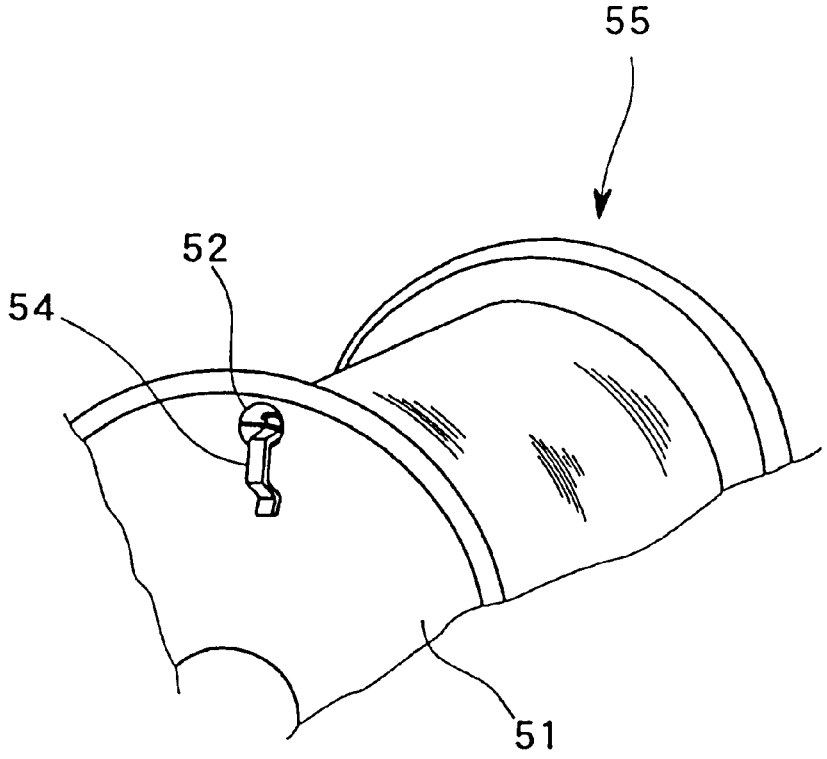
Fig. 13a PRIOR ART
FIG. 13 shows another metal wire winding reel according to the prior art, FIG. 13(*a*) being a partially broken perspective view, and FIG. 13(*b*) being an enlarged sectional view showing a main part in an engagement state of an end of a metal wire.
Figure 13B:
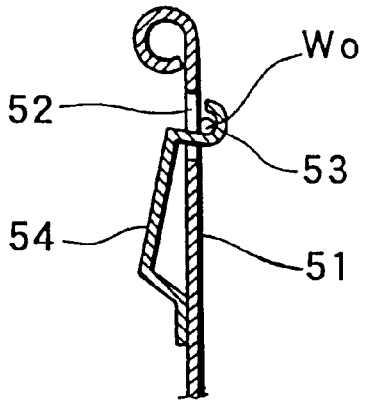
Fig. 13b PRIOR ART
Figure 14A:
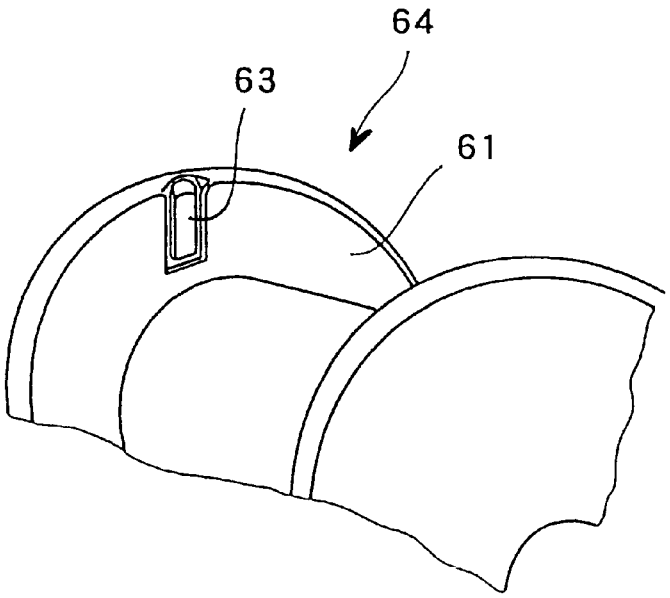
Fig. 14a PRIOR ART
FIG. 14 shows a further metal wire winding reel according to the prior art, FIG. 14(*a*) being a partially broken perspective view, and FIG. 14(*b*) being an enlarged sectional view showing a main part.
Figure 14B:
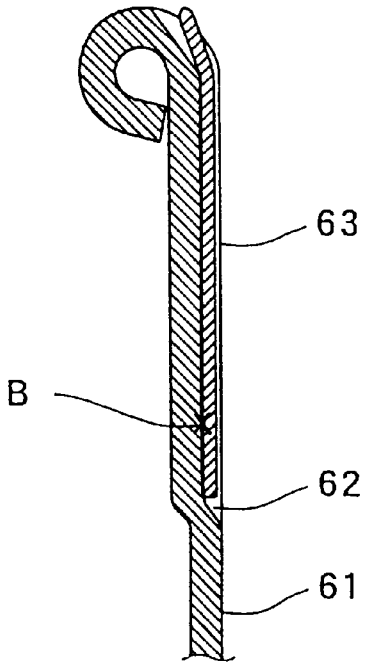
Fig. 14b PRIOR ART
Figure 15:
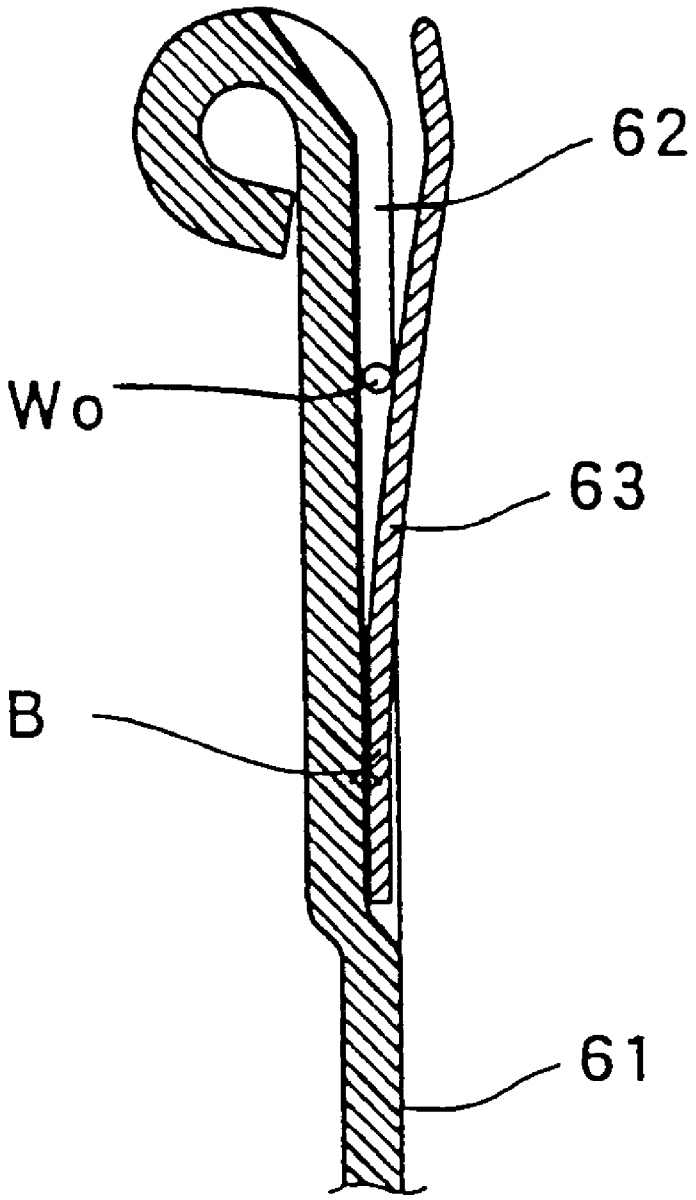
Fig. 15 PRIOR ART
FIG. 15 is an enlarged sectional view showing a main part in an engagement state of an end of a metal wire of the reel in FIG. 14.

As shown in FIGS. 11(*a*) and 11(*b*), a step portion 28*a* is formed on a groove 28 and a guide portion 30 is continuously provided at each side of the step portion 28*a* so as to cause an outer peripheral edge 29 of a flange to remain.

Thus, the guide portion 30 is continuously provided on both sides of the groove 28 having the step portion 28*a*. Therefore, the guide portion 30 acts as a guide during engagement of the end of the metal wire and wire release so that lead-in and lead-out operations can smoothly be performed. Thus, a work of engaging the end of the metal wire can easily be carried out. Since the outer peripheral edge 29 of the flange remains on the outer periphery of the guide portion 30, an end engaging member 31 does not come in contact with other reel flanges, jigs and the like during handling or reel transportation. Consequently, it can be expected that the end engaging member is prevented from being damaged.

A groove 32 is provided in a tip portion of the end engaging member 31. Therefore, the end of the metal wire is fitted in the groove 32 so that it can be fixed in a constant position. Accordingly, the end engaging member 31 is not greatly warped. Consequently, the end engaging member 31 can be prevented from being broken. Furthermore, the groove 32 functions as a stopper so that the end of the metal wire can surely be prevented from coming off.

The reel according to the present invention has the above-mentioned structure. Consequently, a work of passing the end of the metal wire through a small hole is not required unlike the prior art. Furthermore, it is not necessary to perform a work of covering the end with a tape or fusing strands to each other by welding. Thus, a work of engaging the end of the metal wire and that of releasing the metal wire can be performed very easily. Consequently, working properties can greatly be enhanced.

In addition, a stress does not converge on a fixing portion of a base of the end engaging member and the outside surface of the flange. Therefore, the end engaging member is deformed or broken with difficulty. Thus, the reel can be used for a long period of time.

Furthermore, the end of the metal wire can easily be led in from the guide portion and can surely be engaged in the engaging portion. Therefore, the wire can be prevented from coming off during the handling. In addition, the work of engaging the end of the metal wire and that of releasing the metal wire can automatically be performed.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A metal wire winding reel comprising a winding drum and a flange at each end of a winding drum and a groove provided in a radial direction to an outer peripheral edge of the flange on an inside surface of the flange and a flat end engaging member installed in the groove, characterized in that said groove includes a bottom slot, a base of the flat end engaging member extends through the groove bottom slot and protrudes from an outside surface of the flange through the inside surface of the flange and is fixed on the outside surface of the flange, and an engaging portion including a hemispherical projection provided on the inside surface of the flange in the proximity of the groove.

2. The metal wire winding reel according to claim 1, wherein the engaging portion comprises a continuous unevenness provided in at least one side of a boundary corner portion of both sides of the groove and the inside surface of the flange.

3. The metal wire winding reel according to claim 1 or 2, wherein the engaging portion comprises a corrugated convex portion provided in the groove in contact with the back of the flat end engaging member parallel to a winding direction of the metal wire.

4. The metal wire winding reel according to claim 1, wherein a tip corner of the flat end engaging member is chamfered.

5. The metal wire winding reel according to claim 1 or 2, wherein the engaging portion comprises a groove provided on the flat end engaging member parallel to the winding direction of the metal wire.

6. The metal wire winding reel according to claim 1 or 2, wherein the engaging portions are provided on a tip of the flat end engaging member and the groove facing said tip, respectively, and one is a projection and the other is a recess.

7. The metal wire winding reel according to claim 1 or 2, wherein the engaging portions are provided on a tip of the flat end engaging member and the groove facing said tip, respectively, and one is a projection and the other is a small penetrating hole.

8. The metal wire winding reel according to claim 1 or 2, wherein a guide portion is provided on the inside surface of the flange of both sides of the groove so as to lead to corners of both sides of the groove and the outer peripheral edge of the flange.

9. The metal wire winding reel according to claim 2, wherein a step portion is formed on an upper portion of the groove so that a clearance which is almost equal to a diameter of the metal wire is formed between the groove and the flat end engaging member.

* * * * *

UNITED STATES PATENT AND TRADEMARK OFFICE

CERTIFICATE OF CORRECTION

PATENT NO. : 5,931,408

DATED : August 3, 1999

INVENTOR(S) : ISAO ISHII, ET AL.

It is certified that error appears in the above-identified patent and that said Letters Patent is hereby corrected as shown below:

Col. 12, line 9, claim 9, change "claim 2" to --claim 8--.

Signed and Sealed this

Nineteenth Day of September, 2000

*Attest:*

Q. TODD DICKINSON

*Attesting Officer*

*Director of Patents and Trademarks*